US006203421B1

(12) United States Patent
Black

(10) Patent No.: US 6,203,421 B1
(45) Date of Patent: Mar. 20, 2001

(54) SAFETY CEILING VENT

(76) Inventor: Ervin H. Black, 4320 S. Grove, Stickney, IL (US) 60402

( * ) Notice: Subject to any disclaimer, the term of this patent is extended or adjusted under 35 U.S.C. 154(b) by 0 days.

(21) Appl. No.: 09/493,421

(22) Filed: Jan. 29, 2000

(51) Int. Cl.[7] ..... F24F 11/00
(52) U.S. Cl. ..... 454/194; 454/358; 454/369
(58) Field of Search ..... 454/194, 358, 454/362, 369

(56) References Cited

U.S. PATENT DOCUMENTS

| | | | | |
|---|---|---|---|---|
| 778,204 | | 12/1904 | Porter . | |
| 942,707 | | 12/1909 | Birnstock . | |
| 3,182,581 | * | 5/1965 | Poederoyen et al. | 454/194 X |
| 3,728,956 | | 4/1973 | Field . | |
| 3,981,317 | * | 9/1976 | Strulik et al. | 454/369 X |
| 4,080,978 | | 3/1978 | McCabe | 137/79 |
| 4,132,160 | | 1/1979 | Robertshaw . | |
| 4,397,223 | * | 8/1983 | Maxson | 454/257 X |
| 4,958,687 | | 9/1990 | Nakagawa | 169/60 |

FOREIGN PATENT DOCUMENTS

| | | | | |
|---|---|---|---|---|
| 2 323 082 | * | 4/1977 | (FR) | 454/369 |
| 2 338 091 | * | 8/1977 | (FR) | 454/369 |

* cited by examiner

*Primary Examiner*—Harold Joyce
(74) *Attorney, Agent, or Firm*—Philip H. Kier

(57) ABSTRACT

A ceiling vent to reduce the temperature in a room that is subject to becoming uncomfortably hot. The vent contains two concentric tubes, one movable and the other stationary. The movable tube is attached to a damper plate so that when the movable tube is lowered, the vent opens. Attached to the stationary tube is a plastic fuse pin in a metal sleeve that engages a notch in the stepped upper portion of the movable tube. There is a spring attached at one end to the metal sleeve and at the other end to the damper plate. When the vent is opened, the spring is stretched. Should there be a fire in the room being vented, hot air rising through the vent would cause the plastic fuse pin to soften or melt, which would cause the plastic fuse pin to disengage from a notch and allow the spring to resume its rest position and close the vent.

5 Claims, 4 Drawing Sheets

SAFETY CEILING VENT

BACKGROUND OF THE INVENTION

This invention relates to a ceiling vent for releasing heat from a room to reduce the temperature in the room to thereby enhance comfort and reduce the load on energy-consuming air-conditioning units. The vent has a safety feature that causes it to close when the temperature in the vent becomes hot enough to indicate a fire or when it is subject to a shock indicative of an explosion. The vent can be used in any room that becomes uncomfortably hot, especially rooms with sun exposure and kitchen with heating-releasing appliances such as refrigerators, stoves, and ovens.

SUMMARY OF THE INVENTION

The invention comprises a duct pipe that extends through a hole in the ceiling of a room. There is a damper plate that is in contact with the ceiling when the vent is closed. The damper plate would contact a tube called the lower guide. The top of the lower guide is a series of stepped notches. The vent contains another tube, the upper guide, concentric with the lower guide. Attached to the upper guide is a metal sleeve encompassing part of a plastic fuse pin. When the vent is closed, the fuse pin engages the lowest notch of the lower guide. The two concentric tubes contain a spring. A hook attached to the upper end of the spring loops around the metal sleeve. A second hook at the bottom of the spring engages a retaining screw that is attached to the bottom lower guide. To lower the damper plate and open the vent, the second hook is lowered and rotated until the fuse pin engages the notch on the lower guide that results in the desired opening of the vent. The fuse pin is made of a plastic with a relatively low melting point. The fuse pin would melt when air with temperatures characteristic of a fire in the room being ventilated passes through the vent. Melting of the fuse pin would cause it to disengage the notch on the lower guide, which results in the damper plate closing. Shock from an explosion could cause the damper plate to slide up the lower guide to close the vent a short time before heat from the explosion would cause the fuse pin to melt.

A ceiling vent helps to cool a room using the property that warmer air is less dense than cooler air and consequently tends to rise and escape through the vent. It is a simple, inexpensive way to provide some cooling to enhance comfort or reduce the load on air conditioning units. However, building codes provide that if a room has a ceiling vent, that vent should close in the event of a fire to close a pathway for the fire to another area. Thus it is one object of this invention to provide a ceiling vent that will close in the event of a fire. An explosion may lead to the spread of fire. Thus, it is another object of this invention to provide a ceiling vent that will close in event of an explosion.

DETAILED DESCRIPTION OF THE INVENTION

Figure 1:
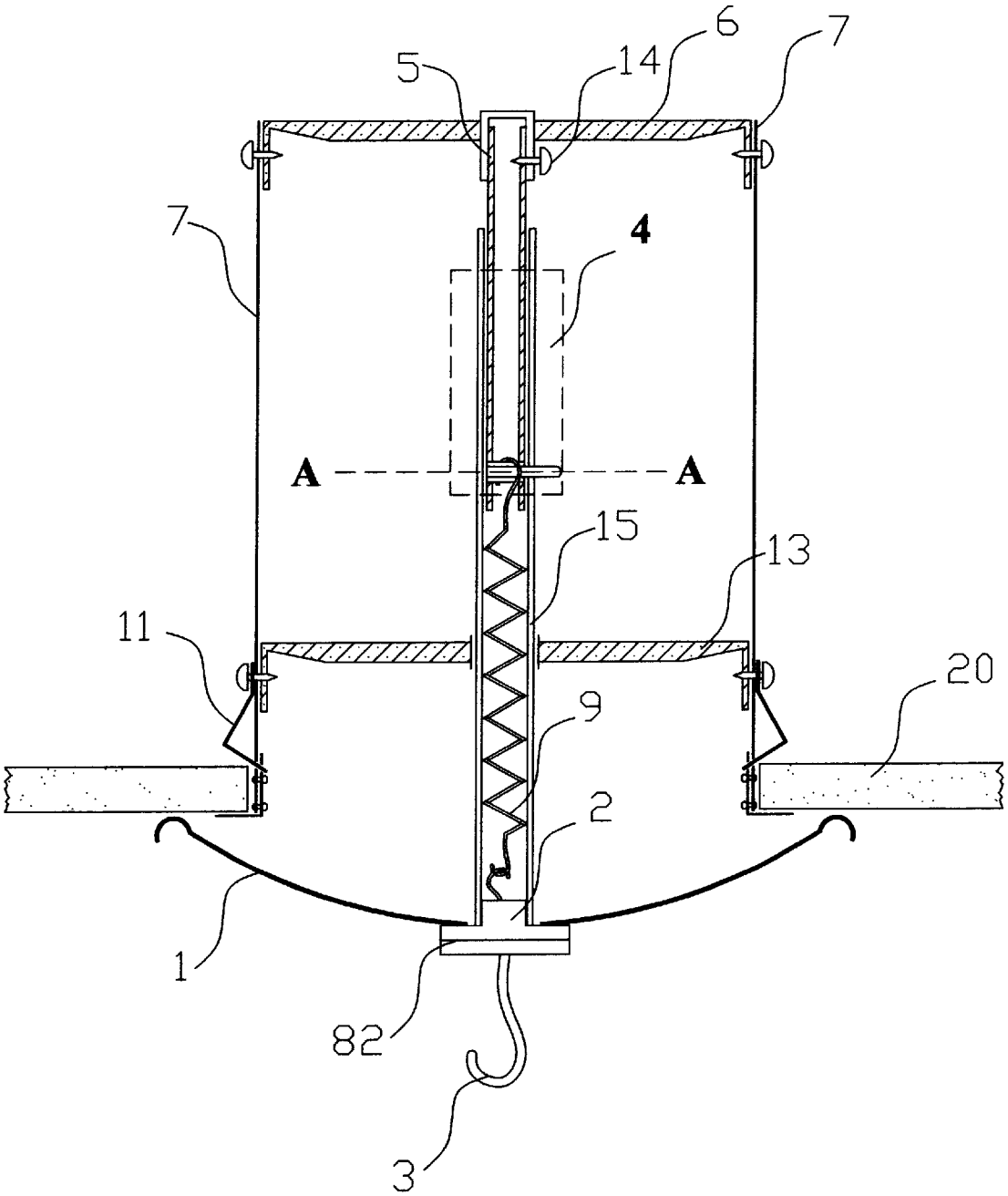
FIG. 1 is an elevation view of the safety ceiling vent with the damper plate in contact with the ceiling.
Figure 2:
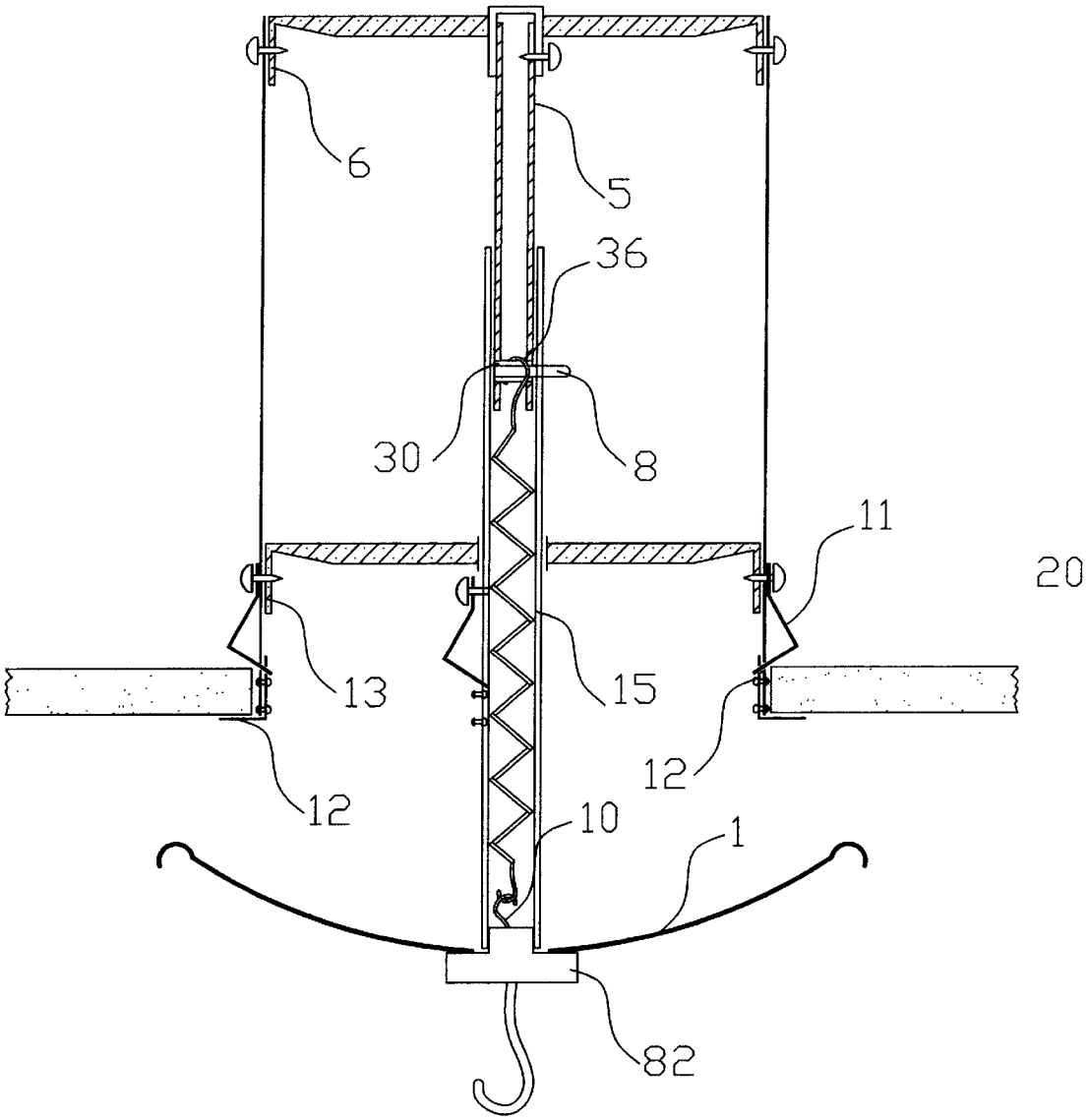
FIG. 2 is an elevation view of the safety ceiling vent with the damper plate lowered from the ceiling.
Figure 3:
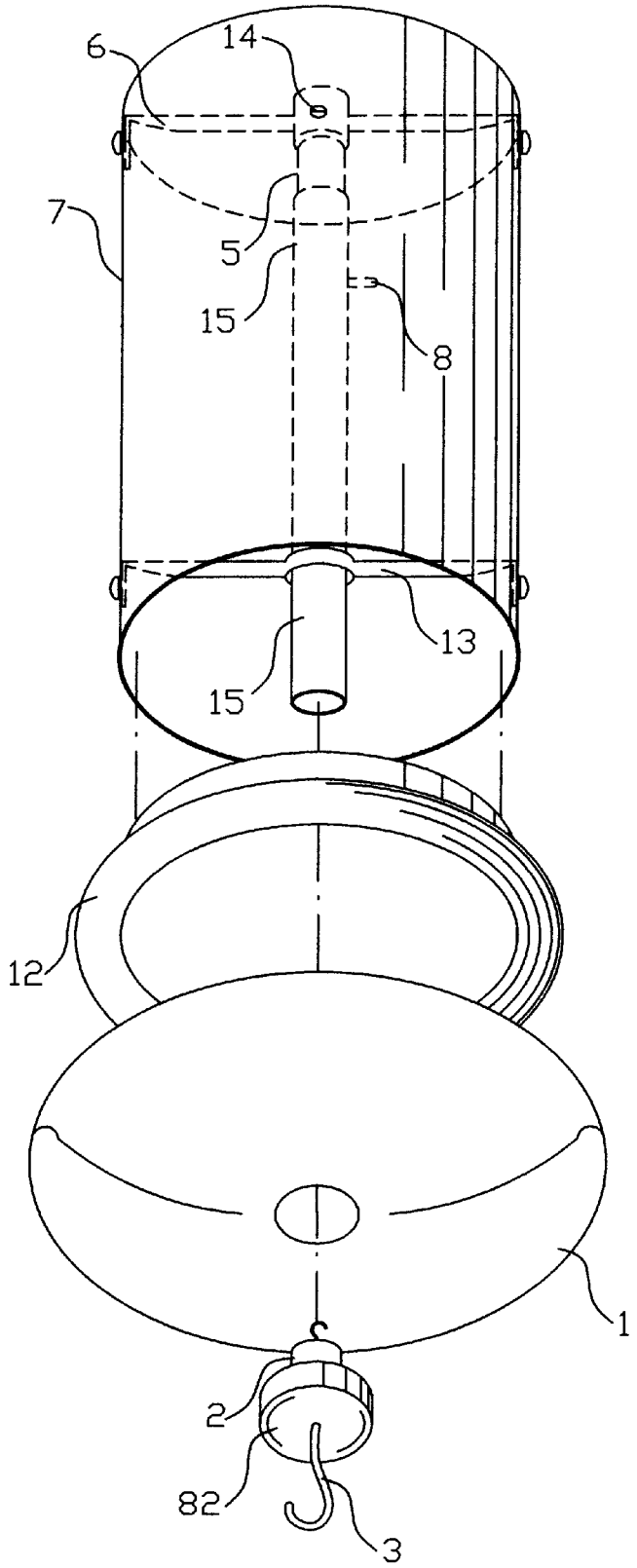
FIG. 3 is an exploded perspective view of the safety ceiling vent.
Figure 4:
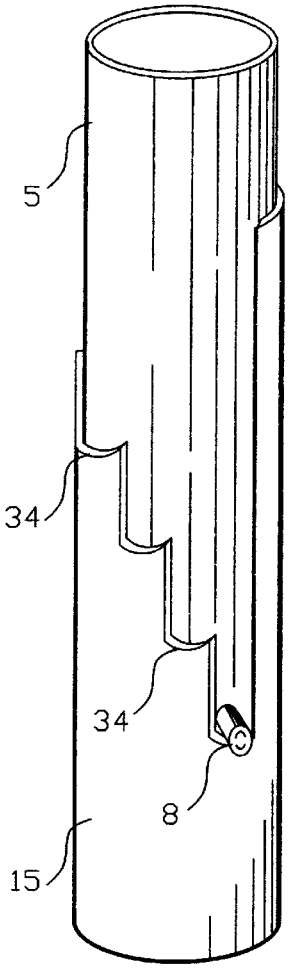
FIG. 4 is a perspective view of the upper guide, lower guide, and fuse pin.
Figure 5:
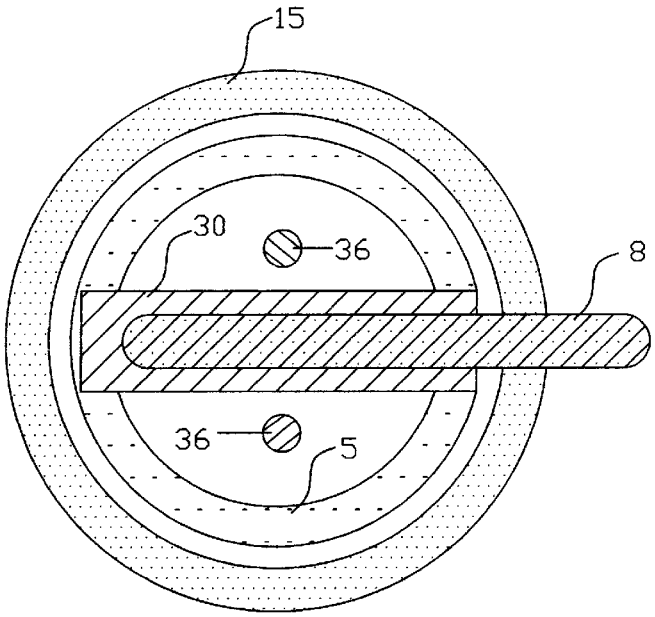
FIG. 5 is a view along cross section A—A in FIG. 1 showing the metal sleeve and fuse pin.

With reference to the drawings, the invention contains a duct pipe 7 that would be inserted in a hole in a ceiling. In the preferred embodiment, the duct pipe would be galvanized metal and cylindrical in shape. Its lower end would be secured to the bottom of the ceiling 20 by use of a retaining ring and flashing 12, and it would be secured to the top of the ceiling by means of spring clips 11 that press against the top of the ceiling. At the top of the vent, a metal bar 6, called the upper hanger, is attached to the duct pipe. Attached to the upper hanger by means of screws or rivets 14 is a tube called the upper guide 5. Attached to the upper guide and passing through it horizontally is a metal sleeve 30. Placed within the metal sleeve and extending beyond it is a plastic fuse pin 8. The plastic fuse pin is made of a plastic material that will melt when air with a temperature indicating a fire in the room being ventilated passes through the vent. High Impact Polystyrene (H.I.P.S.) is an appropriate material for the fuse pin. Its maximum working use temperature is 74° C. (165° F.). Its soft temperature is in the range of 85° C. to 93° C. (185–200° F.) and its total melt temperature is 121° C. (250° F.).

Concentric with the upper guide 5 and with a slightly larger diameter is a second tube, the lower guide 15. The upper part of the lower guide is a series of stepped notches 34. A spring 9 is contained within the lower guide 15 and the upper guide 5. Attached to the top of the spring is an upper spring hook 36 that loops around the metal sleeve 30. Attached to the top of a retaining plug 2 is a lower spring hook 10, which loops around the bottom of the spring 9. Also in contact with the retaining plug is the inner surface of the lower guide 4. Attached to the bottom of the retaining plug is a hook 3. The vent also contains a damper plate 1, part of which contacts the bottom of the ceiling when closed and which is in contact with the outer surface of the lower guide 15 and the retaining plug 2. The vent may also have a horizontal stability bar 13 attached to the duct pipe 7 and containing a hole to allow passage of the lower guide.

The fuse pin 8 engages the lowest notch of the lower guide when the spring is at rest and the damper is closed. The vent is opened or closed as described below. When the vent is closed, it can be opened by lowering and rotating hook 3. This causes the damper plate 1 and the lower guide 15 to be lowered and rotated. When the lower guide is lowered certain discrete distances, the fuse pin will engage a higher notch in the lower guide and the opening of the damper plate can be maintained. Four stepped notches on the lower guide will support three open positions and the closed position of the damper plated.

Because the height of the plastic fuse pin 8 is not changed when the lower guide 4 is lowered, the position of the top of the spring 9 is not changed. However, the bottom of the spring is lowered when the lower guide is lowered; this puts the spring under tension. However, the spring cannot return to its rest position because the fuse pin engages a notch in the lower guide and prevents the lower guide from rising. To close the vent or to reduce the size of the opening through which air enters the vent, the hook is rotated and raised until the fuse pin engages the desired notch.

If there is fire in a room being ventilated, the temperature of the air passing through the vent will increase until the temperature is sufficient to cause the fuse pin 8 to melt. When the fuse pin melts, it will disengage from the notch. The upper spring hook 36 is still hooked over the metal sleeve 30 to fix the elevation of the top of the spring.

However, because nothing is engaged with a higher notch to keep the spring under tension, the spring will tend to resume its rest position. As the height of the top of the spring is fixed, the bottom of the spring will rise when it resumes its rest position causing the retaining plug 2, lower guide 15, and damper plate 1 to rise. When the spring has reached it rest position, the damper plate will have closed by contacting the bottom of the ceiling.

The damper plate is not attached to the lower guide, but rather rests on a ledge 82 of the retaining plug 2. If there is an explosion in the room being ventilated, the resulting shock wave could raise the damper plate 1 to slide up the lower guide and thereby close the vent. This mechanism could cause the vent to close before heat from the explosion would cause the fuse pin to melt.

I claim:

1. A room ceiling vent for emplacement in a hole in a ceiling with a bottom surface comprising:

a duct pipe;

a stationary tube within the duct pipe;

a metal bar attached to the duct pipe and to the stationary tube;

a movable tube with a curved surface, concentric with the stationary tube and partly enclosing the stationary tube, an upper part of the movable tube being a plurality of stepped notches with a lowermost notch and higher notches that ascend along the curved surface of the movable tube;

a metal sleeve integrally attached to the stationary tube;

a plastic fuse pin inserted into the metal sleeve and extending beyond the metal sleeve, the plastic fuse pin made of a material that becomes soft when temperature of air entering the duct pipe indicates fire in the room;

a spring with a first top attachment means and a bottom attachment means, the first top attachment means engaging the metal sleeve;

a retaining plug with a ledge, a second top attachment means, and a bottom handling means, the movable tube attached to the retaining plug, the top attachment means of the retaining plug engaging the bottom attachment means of the spring;

a damper plate in contact with the ledge of the retaining plug and with the movable tube but not fixed to the retaining plug nor to the movable tube.

2. A ceiling vent as set forth in claim 1 wherein the fuse pin engages the lowermost notch of the movable tube when the spring is at rest.

3. A ceiling vent as set forth in claim 2 wherein the plastic fuse pin is high impact polystyrene with soft melting beginning near 85° C.

4. A ceiling vent as set forth in claim 3 wherein the top attachment means of the spring, the bottom attachment means of the spring, and the top attachment means of the retaining plug are hooks.

5. A ceiling vent as set forth in claim 4 further comprising a horizontal stability bar with an annular section to allow passage of the movable tube, the horizontal stability bar being attached to the duct pipe.

* * * * *